US005460322A

United States Patent [19]

Carlson et al.

[11] Patent Number: 5,460,322

[45] Date of Patent: Oct. 24, 1995

[54] MULTI-PURPOSE CONTAINER

[75] Inventors: Todd M. Carlson, Moreland Hills; Stephen A. Schultz, University Heights, both of Ohio

[73] Assignee: The Tranzonic Companies, Pepper Pike, Ohio

[21] Appl. No.: 323,797

[22] Filed: Oct. 17, 1994

[51] Int. Cl.[6] ..... B65D 5/54; B65D 5/63

[52] U.S. Cl. ..... 229/120; 206/0.5; 206/806; 229/122; 229/122.1

[58] Field of Search ..... 229/101.2, 103, 229/120, 122, 122.1, 240, 242; 206/0.5, 806; 239/58–60

[56] References Cited

U.S. PATENT DOCUMENTS

| | | | |
|---|---|---|---|
| 1,772,625 | 8/1930 | Caulfield | 229/101.2 |
| 2,005,924 | 6/1935 | Wilson | 229/122.1 |
| 2,352,075 | 6/1944 | Brownsetin | 239/58 |
| 3,066,843 | 12/1962 | Johnson | 229/122.1 |
| 3,190,532 | 6/1965 | Marsh | 229/103 |
| 3,300,115 | 1/1967 | Schauer | 229/122.1 |
| 4,138,052 | 2/1979 | Torigian | 229/122.1 |

FOREIGN PATENT DOCUMENTS

| | | | |
|---|---|---|---|
| 1183269 | 7/1959 | France | 229/101.2 |
| 2342208 | 9/1977 | France | 229/101.2 |

*Primary Examiner*—Gary E. Elkins
*Attorney, Agent, or Firm*—Reese Taylor

[57] ABSTRACT

A convertible container for the storage, transportation, dispensing and utilization of air freshening products includes an elongate tubular box having opposed sidewalls and normally closed ends for the retention of the products. At least one of the sidewalls has a tear-out portion adjacent its corner end for access to the interior for dispensing the product. The sidewalls also have perforated lines extending transversely so that the upper portion of the box may be removed and, in conjunction with generally transversely extending fold lines, the remainder of the box can be converted to a wall mounted dispenser.

19 Claims, 4 Drawing Sheets

MULTI-PURPOSE CONTAINER

BACKGROUND OF THE INVENTION

This invention relates in general to containers for products and relates in particular to a multi-purpose container suitable for transportation, storage and sale of the product, for dispensing of products from within the container, and for mounting the container on a horizontal or vertical surface for use of the product.

DESCRIPTION OF THE PRIOR ART

This invention relates, as noted, to a multi-purpose container and has particular relevance to a container for air fresheners of the type generally sold in block form. The actual active, air freshening product is generally a chemical formulation produced in the form of cubes or blocks, each of which is wrapped in cellophane or a similar covering material for transportation, storage and sale. Upon removal of the wrapper, the active ingredients of the product are exposed to ambient air and serve their function of freshening the ambient air. These products are sometimes sold in three- or four-ounce blocks but, in some instances, are sold in sixteen- and twenty-four-ounce blocks which, of course, are more expensive than the individual, smaller-sized blocks. These larger blocks are then commonly mounted in operational units or dispensers which may be either wall mounted or simply set on a horizontal surface and which have openings in their walls to permit the active ingredients to come into contact with the ambient air.

As noted, the twenty-four- and sixteen-ounce blocks are relatively expensive, and it is often the case that only a few ounces of the active ingredient are necessary to purify or freshen the air in a given environment. In that instance, it is believed desirable to provide some means for utilizing the smaller cubes or blocks to achieve the desired result in a more economical way.

Accordingly, it is believed desirable to provide a multi-purpose container which is dimensioned so as to receive a quantity such as a dozen of the smaller-sized blocks in the three- or four-ounce size and which container can be used for storage and sale of a plurality of the smaller-sized blocks. Moreover, the multi-purpose container of the present invention is capable of being used as a simple dispenser for the blocks by providing a tear-out flap adjacent the bottom from which individual blocks can be removed as desired.

The present multi-purpose container is also designed so that a good portion of the upper part of the overall container can be torn away and the remainder folded down in a unique fashion so as to provide a smaller-sized unit which is capable of receiving, for example, up to four of the four-ounce sized blocks and which can then be wall mounted. This converted bottom portion of the basic container also has tear-out portions in its sidewalls so as to permit the active ingredient to be operative in the mounted condition.

Thus, one may achieve the economies of the smaller sizes without sacrificing secure storage or operational efficiency and the versatile container may be used in varying ways for the storage, transportation, dispensing and functional use of the product and for various sizes of the blocks or cubes.

SUMMARY OF THE INVENTION

It has been found that a multi-purpose container of the type above described can be provided by providing a blank which can be normally formed into an elongate tubular container having four opposed sidewalls and opposed top and bottom ends so as to form a normally closed container of suitable size.

It has also been found that suitable perforations can be provided in the respective sidewalls so as to permit the removal of selected portions of the normally closed container just described in preparation for conversion of the same to a wall-mounted operational unit.

It has also been found that score or fold lines can be provided, in conjunction with the aforesaid perforations so that the container can be reassembled into the aforementioned operational unit.

It has further been found that additional perforations may be provided to provide a tear-out portion adjacent the bottom end for dispensing the blocks when the container is in its original condition and to provide additional tearout portions for communication with ambient air when the container is in its operational condition.

Accordingly, production of an improved multi-purpose dispenser of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
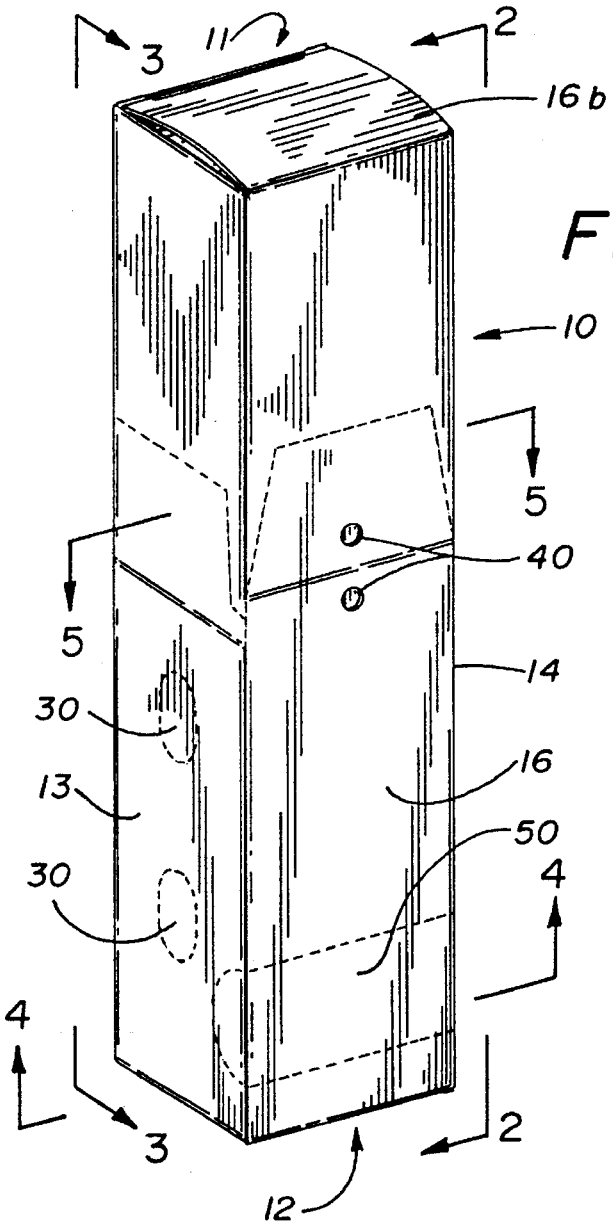
FIG. 1 is a perspective view of the improved container in its fully-assembled condition.
Figure 2:
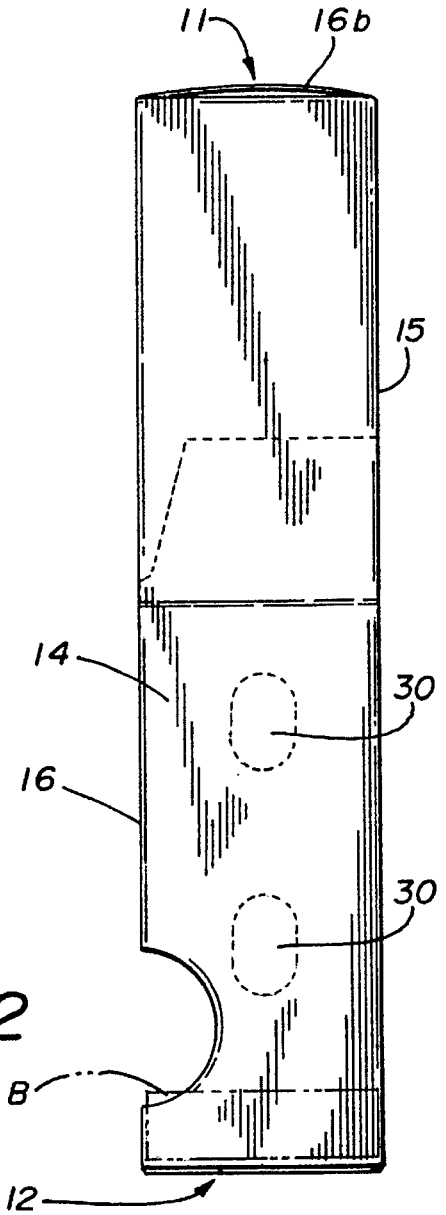
FIG. 2 is an elevational view taken along the line 2—2 of FIG. 1.
Figure 3:
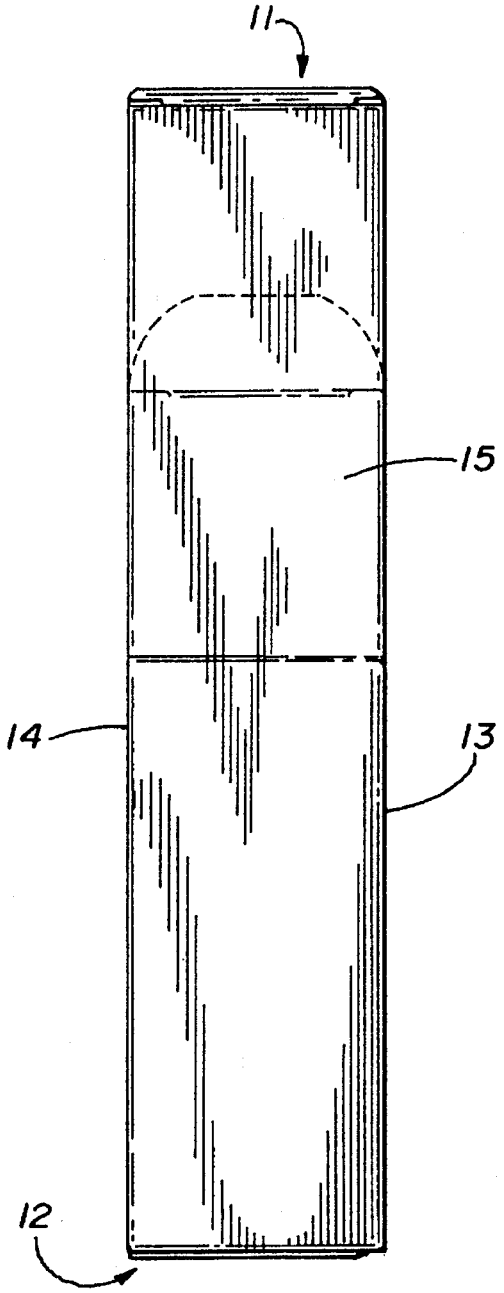
FIG. 3 is an elevational view taken along the line 3—3 of FIG. 1.

Referring first to FIGS. 1 and 2 of the drawings, it will be seen that the container, generally indicated by the numeral 10, in its fully assembled condition includes opposed top and bottom ends 11 and 12 and four opposed sidewalls 13, 14, 15 and 16. The sidewalls 13 and 14, in the assembled condition, are disposed in parallel opposed relationship, and the sidewalls 15 and 16 are also disposed in opposed parallel relationship so as to form the substantially closed unit illustrated in FIGS. 1 through 5 of the drawings. This is what may be referred to herein as the normal or original condition by which is meant its normal or original assembled condition.

Figure 6:
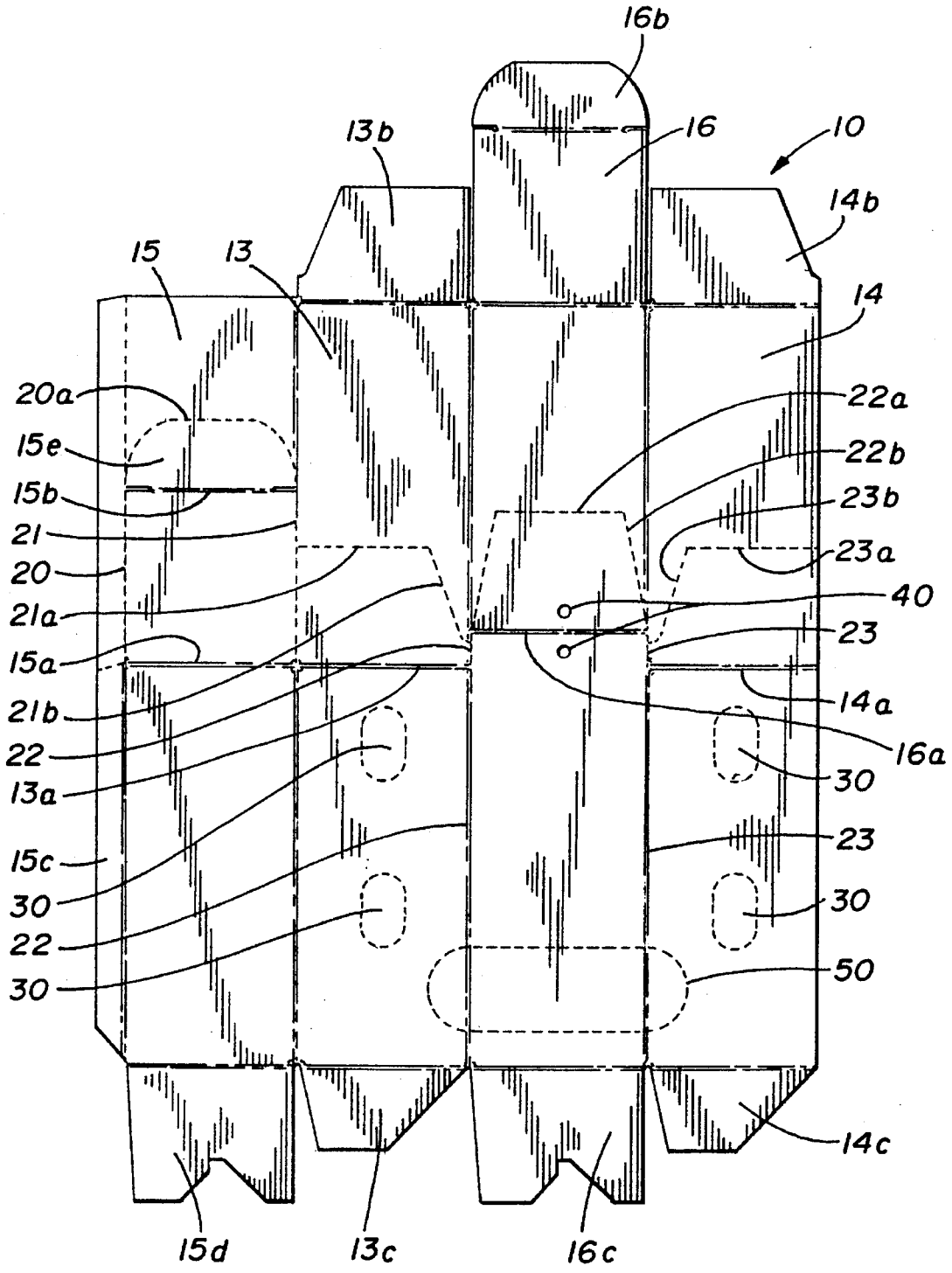
FIG. 6 is a plan view of the blank from which the improved container is formed in unassembled condition.

Referring to FIG. 6 of the drawings, it will be seen that the container of FIG. 1 is formed initially to that condition from a blank of stock material. Sidewall 15 is thus shown as a generally rectangular piece having a flap 15*c* which is intended to overlap part of the sidewall 14 and be glued in place during the assembly operation. The sidewall 15 is scored to provide a first transverse fold line 15*a* disposed approximately at its midpoint longitudinally and a second transverse fold line 15*b* spaced from fold line 15*a* toward the top of the sidewall 15. The edge surface where sidewall 15 joins flap 15*c* is perforated for a portion of its length, as indicated by the numeral 20, for easy separation as will be described. A generally transverse score line 20*a* also extends from side to side of the sidewall 15 to define flap 15*e*. Finally, flap 15*d* projects from the bottom edge of sidewall 15 and is joined thereto by another fold line.

Sidewall 13, which is also generally rectangular in plan, is contiguous with the sidewall 15 and joined thereto by a fold line and by a coextensive perforated tear line 21 so that at least a portion of sidewall 15 can be separated from sidewall 13 in the conversion process.

Sidewall 13 also has a transverse fold line 13a which is coextensive with fold line 15*a* of sidewall 15 and a continuous transverse perforated tear line 21*a* and diagonal tear line 21*b*, so that the portion above the score lines 21*a* and 21*b* can be removed as will be described. End flaps 13*b* and 13*c* also project from the opposed ends of sidewall 13 and are joined thereto by fold lines.

Sidewall 16, which is also generally rectangular in plan, is contiguous with sidewall 13 and also has a transverse fold line 16*a* disposed, in this instance, slightly above the plane of fold lines 13*a* and 15*a* of sidewalls 13 and 15. An edge fold line 22 is also provided, as is a transverse tear line 22*a* and angled tear lines 22*b* so that, again, the portion of sidewall 16 above tear lines 22*a* and 22*b* can be removed in the conversion process. End flaps 16*b* and 16*c* again project from opposed ends of sidewall 16 and are joined thereto by fold lines.

Sidewall 14, which is also generally rectangular in plan, is contiguous with sidewall 16 and has a transverse fold line 14*a* extending transversely thereacross in the same plane as previously described fold lines 15*a*, 13*a*. Sidewall 14 is joined to sidewall 16 by a combined fold tear line 23, similar to fold and tear line 21, and has a transverse perforated tear line 23*a* and a diagonal perforated line 23*b*, as shown in the drawings. End flaps 14*b* and 14*c* again project from opposed ends of sidewall 15 and are joined thereto by fold lines.

As noted, all of the sidewalls have top and bottom flaps, except for the sidewall 15. Thus, the sidewall 15 has only a bottom flap 15*d*, while sidewalls 13, 14 and 16 have lower flaps 13*c*, 14*c*, and 16*c* and also have top flaps 13*b*, 14*b* and 16*b*.

It will further be noted that sidewalls 13 and 14 have tear or punch-out flaps 30,30 framed by perforations for easy activation when the container is converted to its operational mode.

Furthermore, a tear-out flap 50 is provided extending across the face of sidewall 16 adjacent its bottom end and extending into sidewalls 13 and 14 for removal when the container is in its dispensing condition, as will be described.

Figure 4:
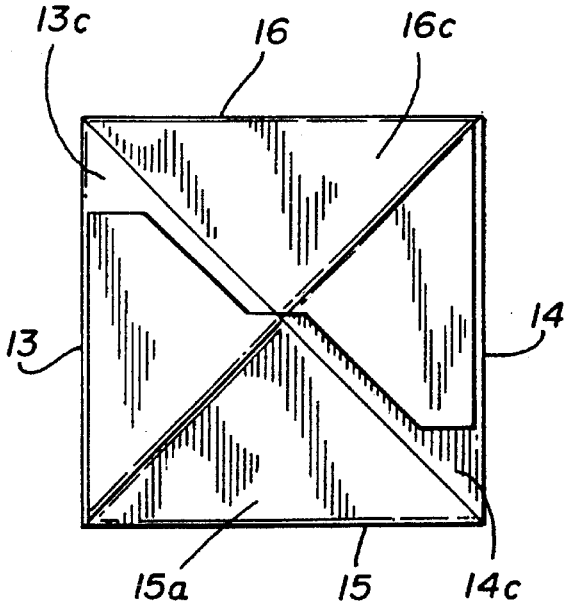
FIG. 4 is a bottom plan view taken along the line 4—4 of FIG. 1.

Assuming that the blank of FIG. 6 has been assembled to the configuration of FIG. 1 which involves folding along lines 20, 21, 22 and 23, gluing flap 15*c* to sidewall 14 and folding the end flaps in a manner shown in FIGS. 1 and 4, it will be seen that an elongate, closed container suitable for transportation, storage and sale of a plurality of the blocks or other products is provided.

If the device is intended to be utilized simply as a dispenser, either at the point of sale or in the purchaser's home or office, it is simply necessary to remove the tear-out flap 50, whereupon the individual blocks B contained inside the container 10 will be readily available and can readily be removed one at a time.

Figure 5:
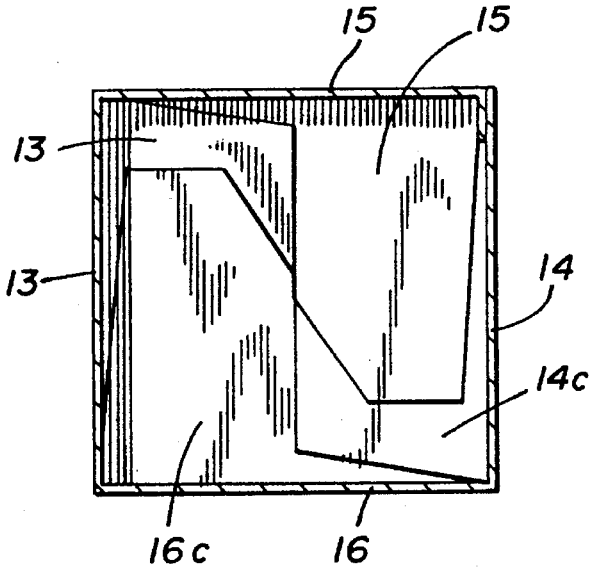
FIG. 5 is a top plan view.
Figure 7:
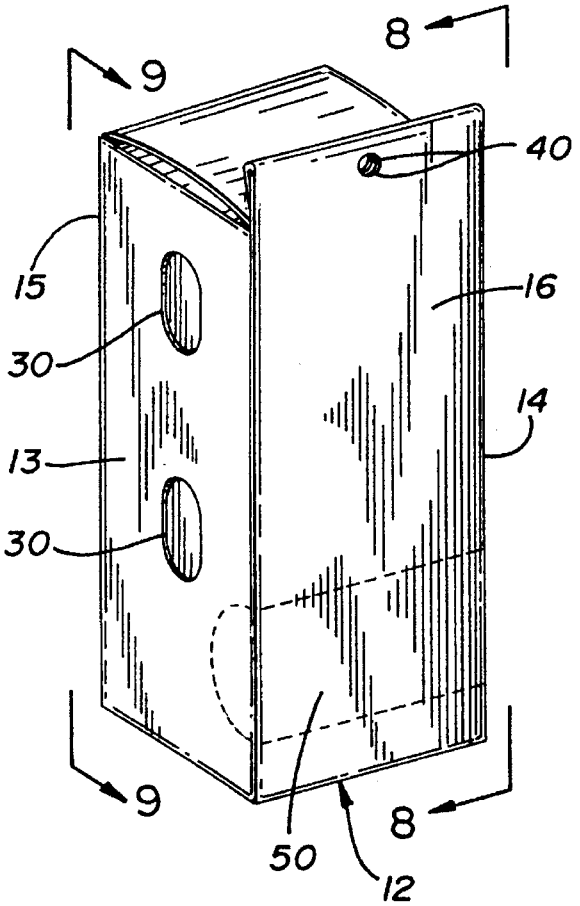
FIG. 7 is a perspective view of the improved container converted for operational use.
Figure 8:
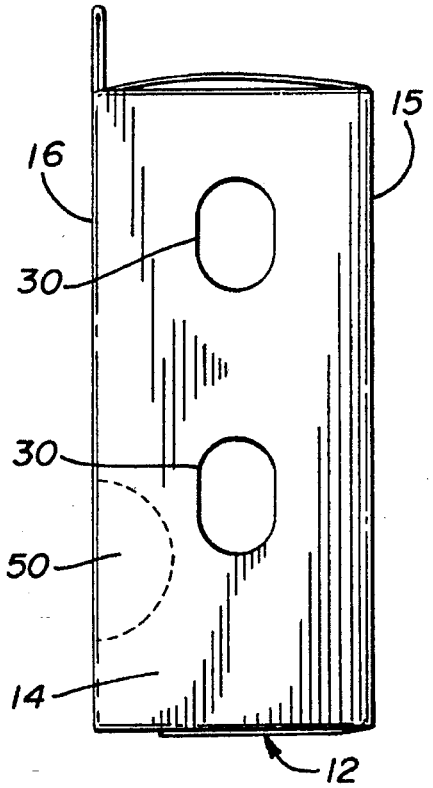
FIG. 8 is an elevational view taken along the line 8—8 of FIG. 7.
Figure 9:
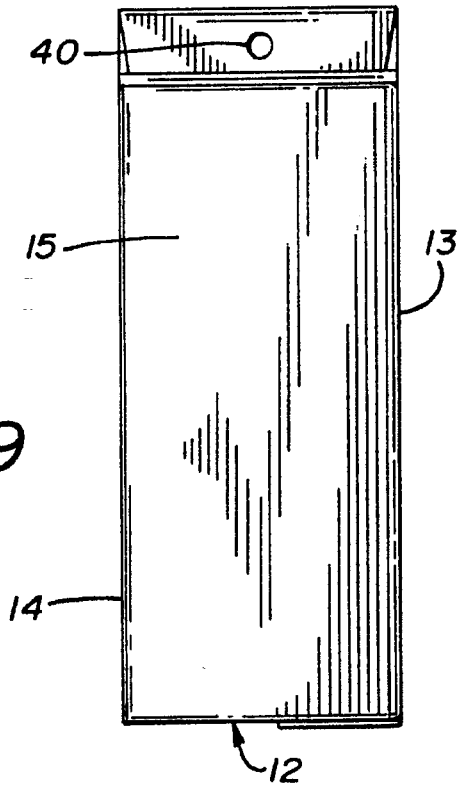
FIG. 9 is an elevational view taken along the line 9—9 of FIG. 7.

In the event it is desired to utilize the container as an actual operational air freshener, it is simply necessary to remove the top portions of the sidewalls 13, 14, 15 and 16 along the tear or perforation lines previously identified. At that point, the remaining projecting portions of sidewalls 13 and 14 can be folded along the fold lines 13*a* and 14*a* so as to partially close the remaining top of what remains of the container as can be seen in FIG. 5. The sidewall 16 is then folded along the fold line 16*a*, and it will be noted that opposed through apertures 40,40 are disposed on each side of that fold line. Therefore, when the extending portion of sidewall 16 is folded thus, these apertures will be in alignment. Furthermore, due to the fact that the fold line 16*a* of sidewall 16 is disposed above the plane of fold lines 13*a* and 14*a* of sidewalls 13 and 14, a hanging or attachment tab will extend above the top of the now converted container, as illustrated in FIG. 7.

To complete assembly of the converted container to its operational condition, it is simply necessary to fold sidewall 15 along the fold lines 15*a* and 15*b*, whereupon that portion will extend across the top of the container and down into the space between the projecting flap and sidewall 16.

Of course, at this point, the tear-out flaps 30,30 would be removed to open the inside to communication with the ambient atmosphere and the product within the modified container will be accessible to the atmosphere and the active ingredients thereof will be enabled to perform their desired function.

While a full and complete description of the invention has been set forth in accordance with the dictates of the Patent Statutes, it should be understood that modifications can be resorted to without departing from the spirit hereof or the scope of the appended claims.

What is claimed is:

1. A convertible container for air freshening products, comprising:

a) a body having a top end, a bottom end and four elongate sidewalls joined along their longitudinal edges including a first pair of sidewalls opposed to each other and a second pair of sidewalls opposed to each other and normal to the planes of the first pair to form a container for receipt of the product;

b) at least one of said top and bottom ends being openable without impairing the structural integrity of said container;

c) said container being convertible to a wall-mounted container for one or more of the products:

d) a portion of each of said sidewalls adjacent said top end joined to the remainder of each of said sidewalls by tear lines;

e) means disposed on one of said sidewalls for mounting the container on a supporting wall; and f) a first removable flap disposed in at least one of said sidewalls for removal of the products.

2. The convertible container of claim 1 wherein said first removable flap extends across one said sidewall and partially across the pair opposed sidewalls immediately adjacent said one said sidewall.

3. The container of claim 1 wherein at least one second removable access flap is disposed in at least one of said sidewalls.

4. The container of claim 2 wherein fold lines are disposed on said first pair of sidewalls at about their longitudinal midpoints and extending transversely of the width of said sidewalls.

5. The container of claim 4 wherein tear lines extend along the longitudinal edges of said first pair of sidewalls from said fold lines toward said top end and transversely for at least a portion of the width of said sidewalls.

6. The container of claim 4 wherein one of said second pair of sidewalls is disposed normally to one of said first pair of sidewalls; and a first fold line is disposed on said one of said second pair of sidewalls coextensive with said fold lines on said first pair of sidewalls.

7. The container of claim 6 wherein tear lines extend along the longitudinal edges of said one of said second pair of sidewalls toward said top end and transversely thereof.

8. The container of claim 7 wherein a second fold line is disposed on said one of said second pair of sidewalls parallel with said first fold line and spaced from said transverse tear line.

9. The container of claim 6 wherein the remaining of said second pair of sidewalls is disposed in opposed relationship with said one of said second pair of sidewalls; and a transverse fold line is disposed on said remaining sidewall closer to said top end than the fold lines on said other sidewalls.

10. The container of claim 9 wherein tear lines extend along the edges of said remaining of said second pair of sidewalls from the plane of said fold lines of said other sidewalls toward said top end and transversely thereof.

11. The container of claim 10 wherein at least a pair of through apertures are disposed in said remaining of said second pair of sidewalls on opposite sides of said transverse fold line.

12. A convertible container for air freshening products, comprising:

a) a body having a top end, a bottom end and four elongate sidewalls joined along their longitudinal edges and including a first pair of sidewalls opposed to each other and a second pair of sidewalls opposed to each other and normal to the planes of said first pair to form a container for the receipt of the products;

b) at least one of said top and bottom ends being openable without impairing the structural integrity of said container;

c) a first removable flap disposed in at least one of said sidewalls for removal of the products;

d) said first removable flap extending across one said sidewall and partially across the opposed sidewalls immediately adjacent said one said sidewall; and e) fold lines disposed on one pair of opposed sidewalls at about their longitudinal midpoints and extending transversely thereof.

13. The container of claim 12 wherein tear lines extend along the longitudinal edges of said first pair of sidewalls from said fold lines toward said top end and transversely for at least a portion of the width of said sidewalls.

14. The container of claim 12 wherein one of said second pair of sidewalls is disposed normally to one of said first pair of sidewalls; and a first fold line is disposed on said one of said second pair of sidewalls coextensive with said fold lines on said first pair of sidewalls.

15. The container of claim 15 wherein tear lines extend along the edges of said one of said second pair of sidewalls toward said top end and transversely thereof.

16. The container of claim 15 wherein a second fold line is disposed on said one of said second pair of sidewalls parallel with said first fold line and spaced from said transverse tear line.

17. The container of claim 14 wherein the remaining of said second pair of sidewalls is disposed in opposed relationship with said one of said second pair of sidewalls; and a transverse fold line is disposed on said remaining sidewall closer to said top end than the fold lines on said other sidewalls.

18. The container of claim 17 wherein tear lines extend along the edges of said remaining of said second pair of sidewalls from the plane of said fold lines of said other sidewalls toward said top end and transversely thereof.

19. The container of claim 18 wherein at least a pair of through apertures are disposed in said remaining of said second pair of sidewalls on opposite sides of said transverse fold line.

* * * * *

UNITED STATES PATENT AND TRADEMARK OFFICE

CERTIFICATE OF CORRECTION

PATENT NO. : 5,460,322

DATED : October 24, 1995

INVENTOR(S) : Todd M. Carlson et al.

It is certified that error appears in the above–identified patent and that said Letters Patent is hereby corrected as shown below:

In Column 6, line 19, delete "claim 15" and substitute therefor —claim 14—.

Signed and Sealed this

Twentieth Day of February, 1996

*Attest:*

Bruce Lehman

BRUCE LEHMAN

*Attesting Officer*

*Commissioner of Patents and Trademarks*